US006200105B1

(12) United States Patent
Kawaguchi et al.

(10) Patent No.: US 6,200,105 B1
(45) Date of Patent: Mar. 13, 2001

(54) CONTROL VALVE IN VARIABLE DISPLACEMENT COMPRESSOR AND METHOD OF MANUFACTURE

(75) Inventors: Masahiro Kawaguchi; Ken Suitou; Masakazu Murase; Hiroshi Kubo, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/010,284

(22) Filed: Jan. 21, 1998

(30) Foreign Application Priority Data

Jan. 21, 1997 (JP) ..... 9-008792

(51) Int. Cl.[7] ..... F04B 49/00
(52) U.S. Cl. ..... 417/222.2; 417/213
(58) Field of Search ..... 417/222.2, 213, 417/270; 251/129.02, 161.5; 137/907

(56) References Cited

U.S. PATENT DOCUMENTS 4,744,733 * 5/1988 Terauchi et al. ..... 417/310
4,842,488 * 6/1989 Terauchi ..... 417/222
5,063,829 11/1991 Takao et al. ..... 92/71
5,145,326 9/1992 Kimura et al. ..... 417/222.2
5,205,718 * 4/1993 Fujisawa et al. ..... 417/222.2
5,531,572 7/1996 Kimura et al. ..... 417/222.2
5,586,870 * 12/1996 Kawaguchi et al. ..... 417/362
5,702,235 * 12/1997 Hirota et al. ..... 417/222.2
5,890,876 * 4/1999 Suito et al. ..... 417/213

FOREIGN PATENT DOCUMENTS 197 16 089A1 11/1997 (DE) .
0 498 552 A1 8/1992 (EP) .
0628722 12/1994 (EP) .

* cited by examiner

*Primary Examiner*—Noah P. Kamen
*Assistant Examiner*—Mahmoud M Gimie
(74) *Attorney, Agent, or Firm*—Morgan & Finnegan, L.L.P.

(57) ABSTRACT

A control valve for a variable displacement compressor. The control valve has a valve body for regulating gas flow. A bellows actuates the valve body through a first rod in accordance with an operating pressure introduced to a pressure sensing chamber. A solenoid biases the valve body through a second rod with a force based on the level or an electric current supplied to the solenoid. The cross-sectional area of the second rod is no smaller than the cross-sectional area of a valve hole of the control valve.

22 Claims, 7 Drawing Sheets

CONTROL VALVE IN VARIABLE DISPLACEMENT COMPRESSOR AND METHOD OF MANUFACTURE

BACKGROUND OF THE INVENTION

The present invention relates to a displacement control valve incorporated in variable displacement compressors that are used in vehicle air conditioners and to a method of manufacture. More particularly, the present invention relates to a displacement control valve that controls the difference between the pressure in a crank chamber and the pressure in cylinder bores, and includes a mechanism for changing a target suction pressure of the compressor.

A typical variable displacement compressor has a supply passage for connecting a discharge chamber with a crank chamber and a displacement control valve located in the supply passage. The displacement control valve controls the opening amount of the supply passage for adjusting the amount of highly pressurized refrigerant gas that is supplied to the crank chamber from the discharge chamber. The pressure in the crank chamber is changed, accordingly. This alters the difference between the pressure in the crank chamber and the pressure in cylinder bores. Changes in the pressure difference adjust the inclination of a swash plate of the compressor and ultimately change the displacement of the compressor.

Japanese Unexamined Patent Publication No 3-23385discloses such a displacement control valve 101 as illustrated in FIG. 7. The control valve 101 includes a housing 102 and a solenoid 111, which is secured to the bottom of the housing 102. The housing 102, together with an inner wall of the compressor, defines a high pressure chamber 109. The housing 102 also includes a low pressure chamber 107 defined in its lower portion and an intermediate pressure chamber 110 located between the chambers 109 and 107. The low pressure chamber 107 accommodates a bellows 108. A valve seat 103 is located between the high pressure chamber 109 and the intermediate chamber 110. The valve seat 103 has a valve hole 104. The upper end of the bellows 108 is coupled to a rod 106, which extends through the valve hole 104. The distal end of the rod 106 is coupled to a valve body 105, which faces the valve seat 103 to open and close the valve hole 104. In other words, the rod 106 connects the valve body 105 with the bellows 108. The low pressure chamber 107 communicates with suction pressure Ps of the compressor. The suction pressure Ps therefore expands or collapses the bellows 108. The high pressure chamber 109 communicates with a discharge chamber of the compressor by the upstream portion of the supply passage. Therefore, the discharge pressure Pd is introduced to the high pressure chamber 109. The intermediate pressure chamber 110 communicates with the high pressure chamber 109 by the valve hole 104 and is connected to the crank chamber by the down stream portion of the supply passage.

A solenoid 111 is secured to the bottom of the housing 102. A fixed steel core 113 is provided at the upper portion of the solenoid 111. A steel plunger 112 is arranged in the solenoid 111 and moves along the axis of the plunger 112. A rod 112*a* is coupled to the plunger 112 and extends through the core 113. A coil 114 is wound about the plunger 112 and the fixed core 113. The top end of the rod 112*a* is attached to the inner wall of the bellows 108. A spring 115 extends between the bottom end of the plunger 112 and the bottom of the solenoid 111. The spring 115 urges the plunger 112 upward. That is, the spring 115 urges the valve body 105 in a direction separating the valve body 105 from the valve seat 103 to open the valve hole 104.

An external control unit (not shown) sends electric current to the coil 114. The magnetic attractive force produced between the plunger 112 and the fixed core 113 is varied by the magnitude of the current from the control unit. The magnitude of the force that pushes the plunger 112 upward, or the force for separating the valve body 105 from the valve seat 103, corresponds to the magnitude of the attraction force. When the solenoid 111 is excited, increasing the suction pressure Ps contracts the bellows 108 and lowers the plunger 112. This causes the valve body 105 and ultimately closes the valve hole 104. Contrarily, lowering the suction pressure Ps expands the bellows 108 and lifts the valve body 105. This opens the valve hole 104. In this manner, the opening area between the valve body 105 and the valve hole 104 is adjusted in accordance with the suction pressure Ps. The level of the suction pressure Ps required for lowering the valve body 105, that is, for moving the valve body 105 toward the valve seat 103, is varied in accordance with the attraction force produced between the armature 112 and the retainer 113.

The above described prior art control valve 101 has the following disadvantages.

If a vehicle having the above compressor, which is connected to an external refrigerant circuit, is caught in a traffic jam in summer, the heat exchange capacity of the condenser in the circuit is significantly lowered. In this case, the valve body 105 closes the valve hole 104 and the compressor operates at the maximum displacement. This results in an extremely high discharge pressure Pd and causes the pressure Pc in the crank chamber to approach the lower suction pressure Ps. In this state, the upper surface of the valve body 105 receives the high discharge pressure Pd and the lower surface of the valve body 105 receives the pressure in the intermediate pressure chamber 110, or the pressure Pc in the crank chamber. A force based on the difference between the pressures Pd and Pc strongly presses the valve body 105 against the valve seat 103. The valve body 105 is therefore not easily moved in a direction to open the valve hole 104 and the responsiveness of the valve body 105 to the suction pressure Ps is degraded In other words, the valve body 105 does not respond to subtle changes in the auction pressure Pa.

If the cooling load falls when the compressor is operating at the maximum displacement, the displacement must be decreased. In order to decrease the displacement, the opening area between the valve body 105 and the valve hole 104 must be enlarged. The valve body 105 thus must be moved by a force that is greater than the force resulting from the difference between the discharge pressure Pd and the crank chamber pressure Pc. That is, the attractive force between the plunger 112 and the fixed core 113 must be increased for enlarging the opening area between the valve body 105 and the valve hole 104. In order to increase the attractive force, the solenoid 111 must be larger. A large solenoid 111 consumes a relatively large amount of electric power and thus increases the load on the alternator.

SUMMARY OF THE INVENTION

Accordingly, it is an objective of the present invention to provide a variable displacement compressor control valve that accurately controls the opening of a valve hole by a valve body and a method of manufacture.

Another objective of the present invention is to provide a variable displacement compressor control valve that has a compact solenoid and a method of manufacture.

To achieve the foregoing and other objectives and in accordance with the purpose of the present invention, a control valve for adjusting the amount of gas flowing in a gas passage in accordance with an operating pressure applied to the control valve is proposed. The control valve includes a housing, a movable valve body, a reacting member, a first rod, a solenoid and a second rod. The housing includes a valve hole and a valve chamber located in the gas passage. The valve hole communicates with the valve chamber. The movable valve body is located in the valve chamber in close proximity to the valve hole. The valve body restricts the valve hole. The reacting member reacts to the operating pressure. The first rod is located between the reacting member and the valve body to transmit the reaction of the reacting member to the valve body. The solenoid is located on the opposite side of the valve body from the reacting member. The solenoid includes a plunger chamber and a plunger movably accommodated in the plunger chamber. A certain level of electric current is applied to the solenoid. The second rod is located between the plunger and the valve body. The plunger applies a force to the valve body through the second rod. The force applied by the plunger is based on the level of electric current supplied to the solenoid. The cross-sectional area of the second rod is no smaller than the cross-sectional area of the valve hole.

The control valve is appropriate for a variable displacement compressor that adjusts the discharge displacement in accordance with the inclination of a drive plate located in a crank chamber.

Also, the present invention provides a method for manufacturing the control valve. The method includes the step of: setting a design cross-sectional area of the second rod larger than a design cross-sectional area of the valve hole such that the actual cross-sectional area of the second rod is no smaller than the actual cross-sectional area of the valve hole.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently prof erred embodiments together with the accompanying drawings.

DETAILED DESCRIPTION OF THE PREFERRED EMBODIMENTS

Figure 1:
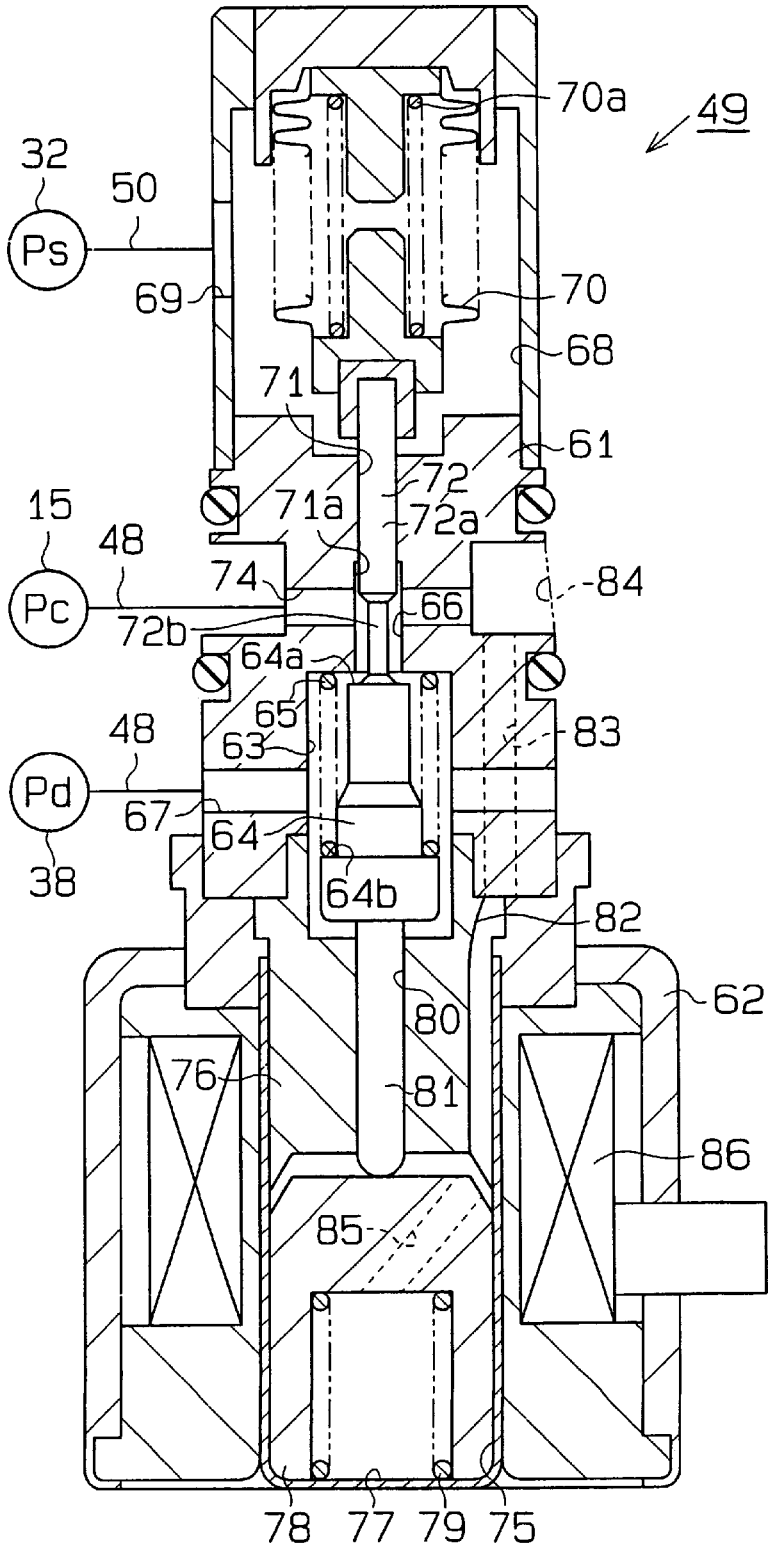
FIG. 1 is a cross-sectional view illustrating a control valve according to one embodiment of the present invention.

A variable displacement compressor control valve according to an embodiment of the present invention will now be described with reference to FIGS. 1 to 5.

Firstly, the structure of a variable displacement housing 12 is secured to the front end face of a cylinder block 11. A rear housing 13 is secured to the rear end face of the cylinder block 11 with a valve plate 14. A crank chamber 15 is defined by the inner walls of the front housing 12 and the front end face of the cylinder block 11.

A drive shaft 16 is rotatably supported in the front housing 12 and the cylinder block 11. The front end of the drive shaft 16 protrudes from the crank chamber 15 and is secured to a pulley 17. The pulley 17 is directly coupled to an external drive source (a vehicle engine E in this embodiment) by a belt 18. The compressor of this embodiment is a clutchless type variable displacement compressor; that is, there is no clutch between the drive shaft 16 and the external drive source. The pulley 17 is supported by the front housing 12 with an angular bearing 19. The angular bearing 19 transfers thrust and radial loads that act on the pulley 17 to the housing 12.

A lip seal 20 is located between the drive shaft 16 and the front housing 12 for sealing the crank chamber 15. That is, the lip seal 20 prevents refrigerant gas in the crank chamber 15 from leaking outside.

A disk-like awash plate 22 is supported by the drive shaft 16 in the crank chamber 15 to be slidable along and tiltable with respect to the axis of the shaft 16. The swash plate 22 is provided with a pair of guiding pins 23, each having a guide ball at the distal end. The guiding pins 23 are fixed to the swash plate 22. A rotor 21 is fixed to the drive shaft 16 in the crank chamber 15. The rotor 21 rotates integrally with the drive shaft 16. The rotor 21 has a support arm 24 protruding toward the awash plate 22. A pair of guide holes 2S are formed in the support arm 24. Each guide pin 23 is slidably fitted into the corresponding guide hole 25. The cooperation of the arm 24 and the guide pins 23 permits the swash plate 22 to rotate together with the drive shaft 16. The cooperation also guides the tilting of the swash plate 22 and the movement of the swash plate 22 along the axis or the drive shaft 16. As the swash plate 22 slides backward toward the cylinder block 11, the inclination of the swash plate 22 decreases.

A coil spring 26 is located between the rotor 21 and the swash plate 22. The spring 26 urges the swash plate 22 backward, or in a direction to decrease the inclination of the swash plate 22. The rotor 21 is provided with a projection 21*a* on its rear end face. The abutment of the swash plate 22 against the projection 21*a* prevents the inclination of the swash plate 22 beyond the predetermined maximum inclination.

Figure 2:
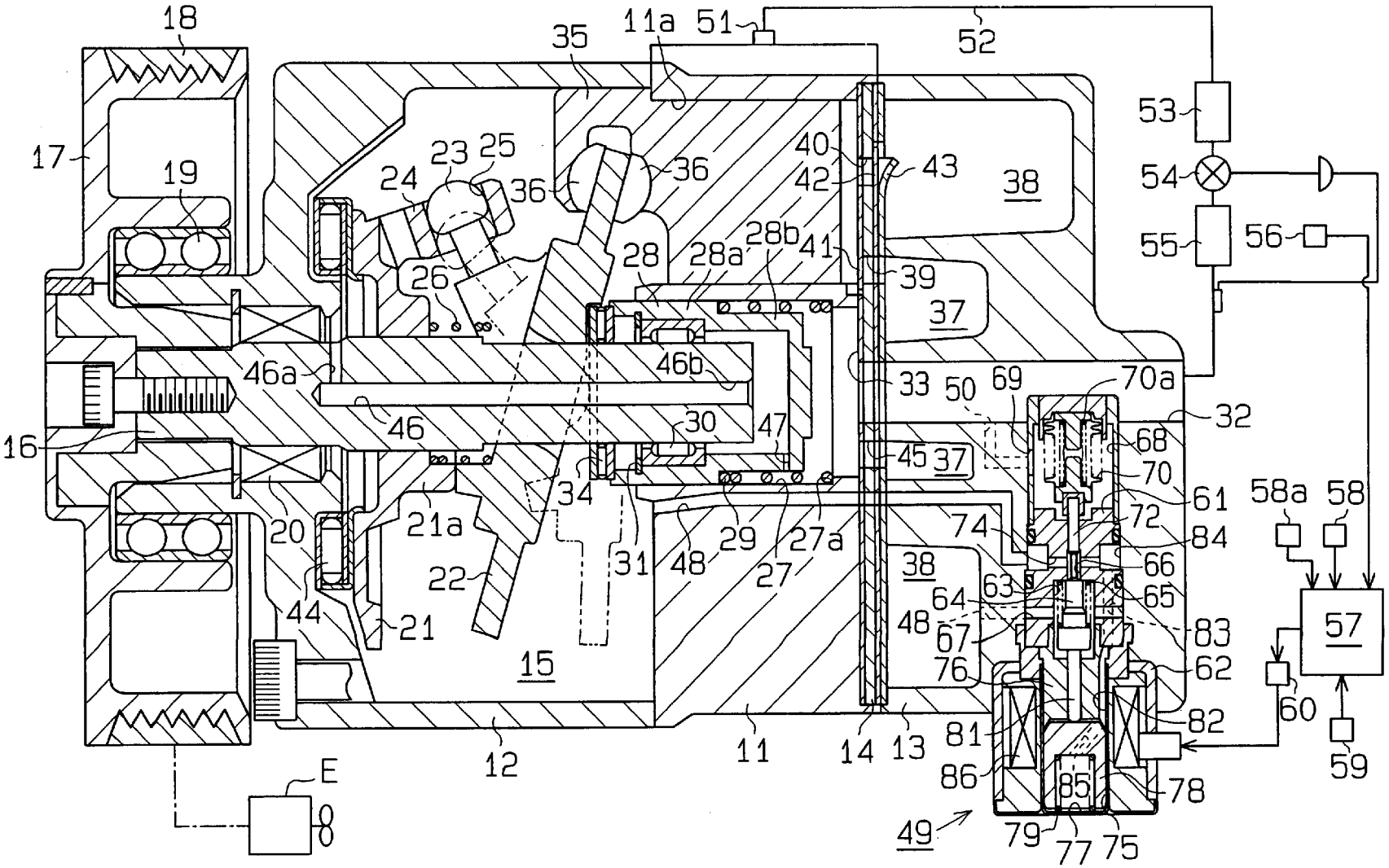
FIG. 2 is a cross-sectional view illustrating a variable displacement compressor including the control valve of FIG. 1.
Figure 3:
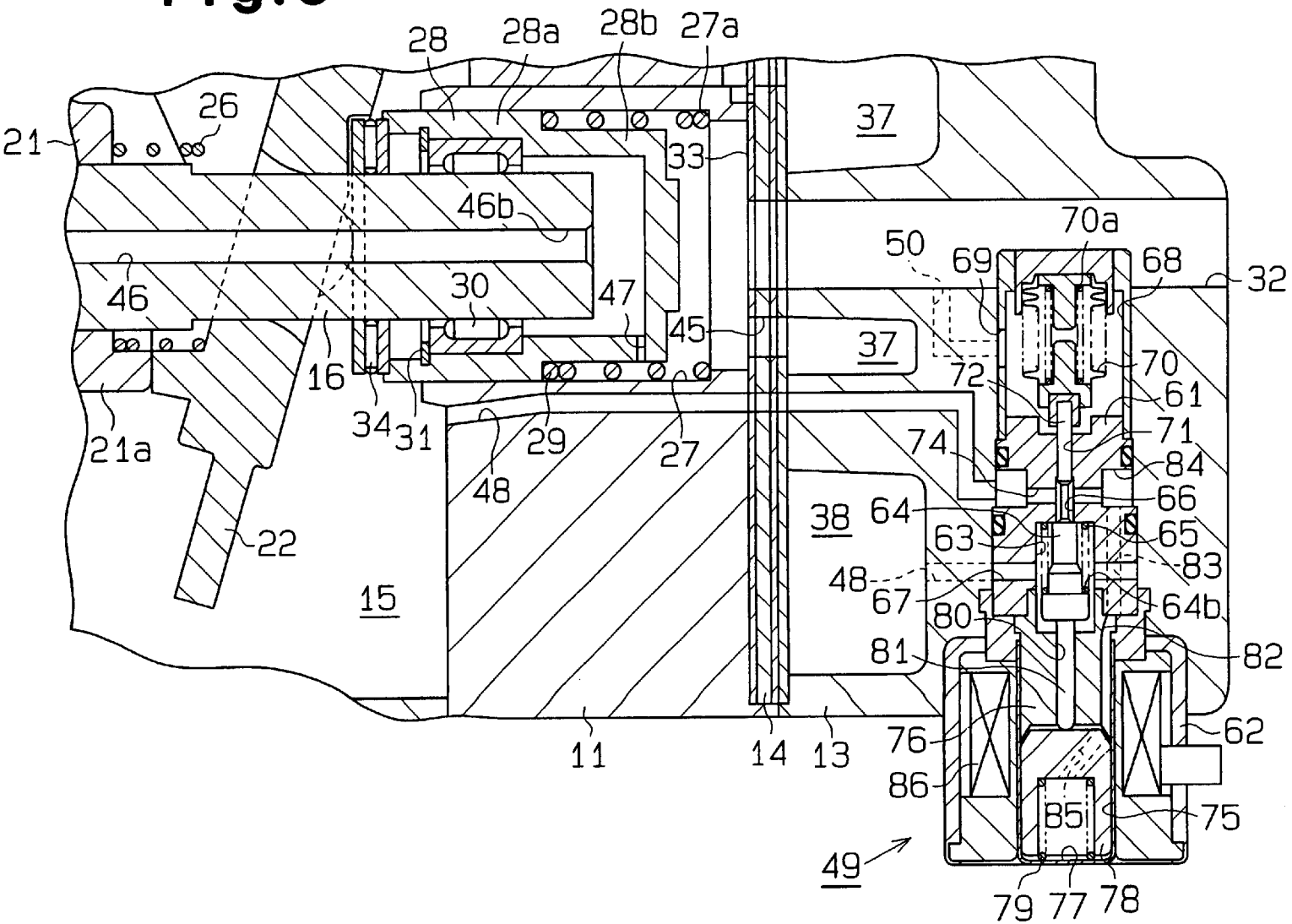
FIG. 3 is an enlarged partial cross-sectional view illustrating the compressor of FIG. 2 when the inclination of the swash plate is maximum.
Figure 4:
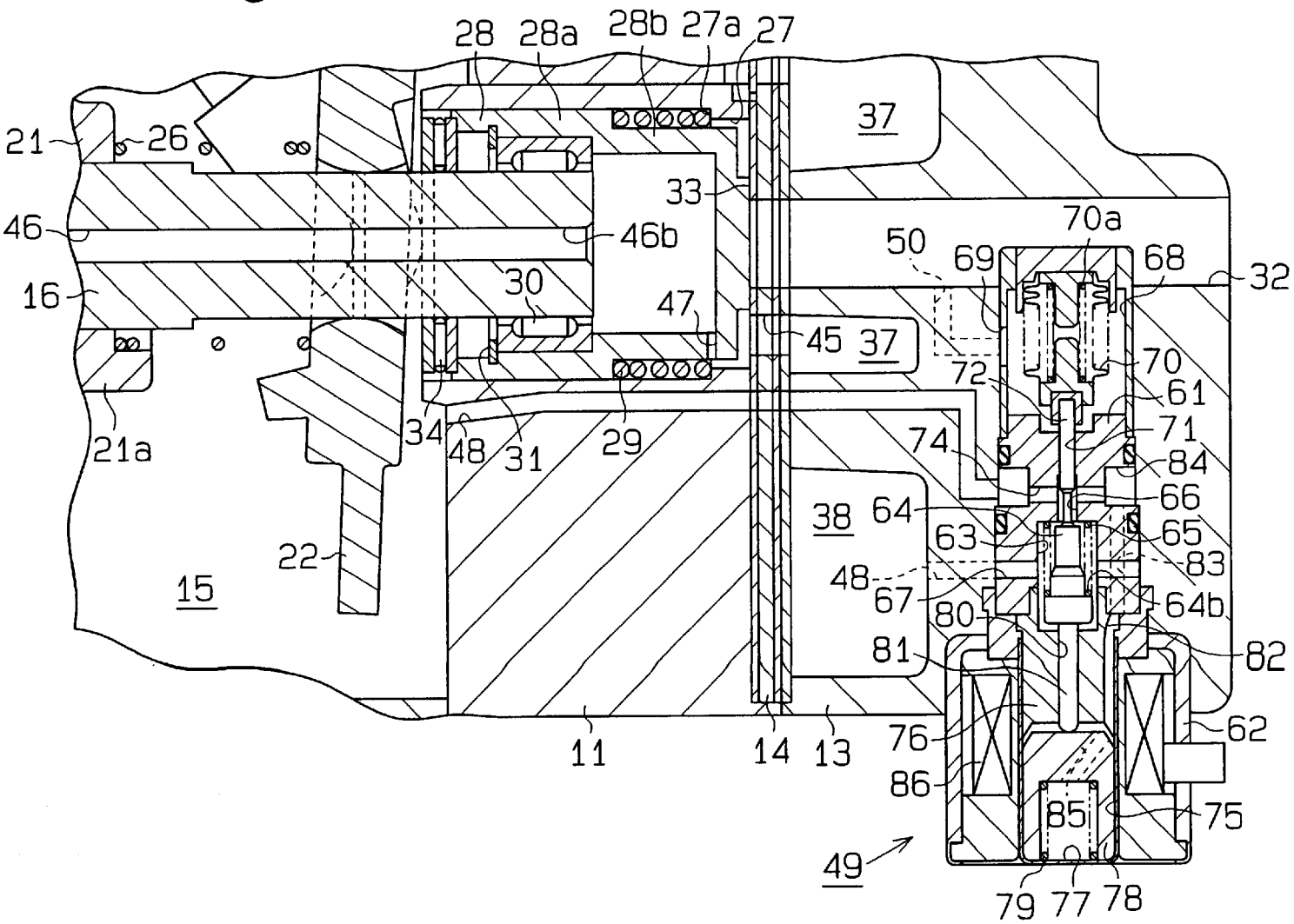
FIG. 4 is an enlarged partial cross-sectional view illustrating the compressor of FIG. 2 when the inclination of the swash plate is minimum.

As shown in FIGS. 2 to 4, a shutter chamber 27 is defined at the center portion of the cylinder block 11 extending along the axis of the drive shaft 16. A hollow cylindrical shutter 28 having a closed end is accommodated in the shutter chamber 27. The shutter 28 slides along the axis of the drive shaft 16. The shutter 28 has a large diameter portion 28*a* and a small diameter portion 28*b*. A coil spring 29 is located between a step 27*a*, which is defined between the large diameter portion 28*a* and the small diameter portion 28*b*, and a wall of the shutter chamber 27. The coil spring 29 urges the shutter 28 toward the swash plate 22.

The rear end of the drive shaft 16 is inserted in the shutter 28. The radial bearing 30 is fixed to the inner wall of the large diameter portion 28*a* of the shutter 30 by a snap ring 31. Therefore, the radial bearing 31 moves with the shutter 28 along the axis of the drive shaft 16. The rear end of the drive shaft 16 is supported by the inner wall of the shutter chamber 27 with the radial bearing 30 and the shutter 28 in between.

A suction passage 32 is defined at the center portion of the rear housing 13 and the valve plate 14. The passage 32 extends along the axis of the drive shaft 16 and communicates with the shutter chamber 27. A positioning surface 33 is formed on the valve plate 14 about the inner opening of the suction passage 32. The rear end of the shutter 28 abuts against the positioning surface 33. Abutment of the shutter 28 against the positioning surface 33 prevents the shutter 29 from further moving backward away from the rotor 21. The abutment also disconnects the suction passage 32 from the shutter chamber 27.

A thrust bearing 34 is supported on the drive shaft 16 and is located between the swash plate 22 and the shutter 28. The thrust bearing 34 slides along the axle of the drive shaft 16. The force of the coil spring 29 constantly retains the thrust bearing 34 between the swash plate 22 and the shutter 28. The thrust bearing 34 prevents the rotation of the awash plate 22 from being transmitted to the shutter 28.

The swash plate 22 moves backward as its inclination decreases. As it moves backward, the swash plate 22 pushes the shutter 20 backward with the thrust bearing 34. Accordingly, the shutter 26 moves toward the positioning surface 33 against the force of the coil spring 29. As shown in FIG. 4, when the swash plate 22 reaches the minimum inclination, the rear end of the shutter 28 abuts against the positioning surface 33. In this state, the shutter 28 is located at the closed position for disconnecting the shutter chamber 27 from the suction passage 32.

As shown in FIG. 2, cylinder bores 11*a* extend through the cylinder block 11 and are located about the axis of the drive shaft 16. A single-headed piston 35 is accommodated in each cylinder bore 11*a*. Each piston 35 is operably coupled to the swash plate 22 by a pair of shoes 36. The swash plate 22 is rotated by the drive shaft 16 through the rotor 21. The rotating movement of the swash plate 22 is transmitted to each piston 35 through the shoes 36 and is converted to linear reciprocating movement of each piston 35 in the associated cylinder bore 11*a*.

An annular suction chamber 37 is defined in the rear housing 13 about the suction passage 32. The suction chamber 37 communicates with the shutter chamber 27 via a communication hole 45. An annular discharge chamber 38 is defined around the suction chamber 37 in the roar housing 13. Suction ports 39 and discharge ports 40 are formed in the valve plate 14. Each suction port 39 and each discharge port 40 correspond to one of the cylinder bores 11*a*. Suction valve flaps 41 are formed on the valve plate 14. Each suction valve flap 41 corresponds to one of the suction ports 39. Discharge valve flaps 42 are formed on the valve plate 14. Each discharge valve flap 42 corresponds to one of the discharge ports 40.

As each piston 35 moves from the top dead center to the bottom dead center in the associated cylinder bore 11*a*, refrigerant gas in the suction chamber 37 enters each piston bore 11*a* through the associated suction port 39 while causing the associated suction valve flap 41 to flex to an open position. As each piston 35 moves from the bottom dead center to the top dead center in the associated cylinder bore 11*a*, refrigerant gas is compressed in the cylinder bore 11*a* and is discharged to the discharge chamber 38 through the associated discharge port 40 while causing the associated discharge valve flap 42 to flex to an open position. Retainers 43 are formed on the valve plate 14. Each retainer 43 corresponds to one of the discharge valve flaps 42. The opening amount of each discharge valve flap 42 is defined by contact between the valve flap 42 and the associated retainer 43.

A thrust bearing 44 is located between the front housing 12 and the rotor 21. The thrust bearing 44 carries the reactive force of gas compression acting on the rotor 21 through the pistons 35 and the swash plate 22.

As shown in FIGS. 2–4, a pressure release passage 46 is defined at the center portion of the drive shaft 16 The pressure release passage 46 has an inlet 46*a*, which opens to the crank chamber 15 in the vicinity of the dip seal 20, and an outlet 46*b*, which opens to the interior of the shutter 28. A pressure release hole 47 is formed in the peripheral wall near the rear end of the shutter 28. The hole 41 communicates the interior of the shutter 28 with the shutter chamber 27.

A supply passage 48 is defined in the rear housing 13, the valve plate 14 and the cylinder block 11. The supply passage 48 communicates the discharge chamber 38 with the crank chamber 15. A displacement control valve 49 is accommodated in the rear housing 13 to regulate the supply passage 48. A pressure introduction passage 50 is defined in the rear housing 13. The passage 50 communicates the control valve 49 with the suction passage 32, thereby introducing suction pressure Ps into the control valve 49.

An outlet port 51 is defined in the cylinder block 11 and is communicated with the discharge chamber 38. The outlet port 51 is connected to the suction passage 32 by an external refrigerant circuit 52. The external refrigerant circuit 52 includes a condenser 53, an expansion valve 54 and an evaporator 55. A temperature sensor 56 is located in the vicinity of the evaporator 55. The temperature sensor 56 detects the temperature of the evaporator 55 and issues signals relating to the detected temperature to a control computer 57. The computer 57 is connected to various devices including a temperature adjuster 58, a compartment temperature sensor 58*a* and an air conditioner starting switch 59. A passenger sets a desirable compartment temperature, or a target temperature, by the temperature adjuster 58.

The computer 57 inputs signals relating to a target temperature from the temperature adjuster 58, a detected evaporator temperature from the temperature sensor 56, and a detected compartment temperature from the temperature sensor 58*a*. Based on the inputted signals, the computer 57 commands a driving circuit 60 to send an electric current having a certain magnitude to the coil 86 of a solenoid 62, which will be described later, in the control valve 49. In addition to the above listed data, the computer 57 may use other data such as the temperature outside the compartment and the engine speed E for determining the magnitude of electric current sent to the control valve 49.

The structure of the control valve 49 will now be described.

As shown in FIGS. 1 and 2, the control valve 49 includes a housing 61 and the solenoid 62, which are secured to each other. A valve chamber 63 is defined between the housing 61 and the solenoid 62. The valve chamber 63 is connected to the discharge chamber 38 by a first port 67 and the supply passage 48. A valve body 64 is arranged in the valve chamber 63. A valve hole 66 is defined extending axially In the housing 61, and opens in the valve chamber 63. The area about the valve hole 66 functions as a valve seat, against which a top end 64*a* of the valve body 64 contacts. A first coil spring 65 extends between a step 64*b* defined on the valve body 64 and a wall of the valve chamber 63 for urging the valve body 64 in a direction to open the valve hole 66.

A pressure sensing chamber 68 is defined at the upper portion of the housing 61. The pressure sensing chamber 68 accommodates a bellows 70 and is connected to the suction passage 32 by a second port 69 and the pressure introduction passage 50. The second port 69 and the passage 50 thus communicates suction pressure Ps in the suction passage 32 with the chamber 68. The bellows 70 functions ma a pressure reacting member that reacts to the suction pressure Ps. A bellows spring 70*a* extends between the upper and lower ends of the bellows 70 for expanding the bellows 70. A first guide hole 71 is defined in the housing 61 between the pressure sensing chamber 68 and the valve hole 66. The axis of the first guide hole 71 is aligned with the axis of the valve hole 66. The first guide hole 71 includes a large diameter portion 71*a*. The portion 71*a* has a diameter that is substantially the same as the diameter of the valve hole 66 and communicates with the hole 66. The large diameter portion 71*a* is formed simultaneously with the valve hole 66.

The bellows 70 is coupled to the valve body 64 by a first rod 72, which is integrally formed with the valve body 64. The first rod 72 has a large diameter portion 72*a* and a small diameter portion 72*b*. The large diameter portion 72*a* extends through and slides with respect to the first guide hole 71. The diameter of the portion 72*a* is smaller than that of the valve hole 66 and that of the large diameter portion 71*a* of the first guide hole 71. In other words, the cross-sectional area of the portion 72*a* is smaller than the cross-sectional area of the valve hole 66. The small diameter portion 72*b* of the rod 72 extends through the valve hole 66 between the large diameter portion 72*a* and the valve body 64. A clearance between the small diameter portion 72*b* and the valve hole 66 permits the flow of refrigerant gas.

A third port 74 is defined in the housing 61 between the valve chamber 63 and the pressure sensing chamber 68. The port 74 extends perpendicularly with respect to the valve hole 66. The valve hole 66 is connected to the crank chamber 15 by the third port 74 and the supply passage 48.

The solenoid 62 has an accommodating cylinder 75 having an open upper end. A fixed steel core 76 is press fitted in the upper opening of the cylinder 75. A plunger chamber 77 is defined by the fixed core 76 and inner walls of the cylinder 75. A cylindrical steel plunger 78 having a closed end is accommodated in the plunger chamber 77. The plunger 78 slides with respect to the chamber 77. A second coil spring 79 extends between the plunger 78 and the bottom of the accommodating cylinder 75. The urging force of the second coil spring 79 is smaller than that of the first coil spring 65.

A second guide hole 80 is formed in the fixed core 76 between the plunger chamber 77 and the valve chamber 63. A second rod 81 is formed integrally with the valve body 64 and projects downward from the bottom of the valve body 64. The second rod 81 is accommodated in and slides with respect to the second guide hole 80. The first spring 65 urges the valve body 64 downward, while the second spring 79 urges the plunger 78 upward. This causes the lower end of the second rod 81 to maintain contact with the plunger 78. In other words, the valve body 64 moves integrally with the plunger 78 with the second rod 81 therebetween.

The design cross-sectional area of the second rod 81 is slightly larger than the design cross-sectional are* of the valve hole 66. When forming the second rod 81 and the valve hole 66, the cross-sectional areas of the second rod 81 and the valve hole 66 have predetermined tolerances. The difference between the design cross-sectional area of the second rod 81 and the design cross-sectional area of the valve hole 66 is determined in consideration of such tolerances. Specifically, the difference is determined such that the actual cross-sectional area of the finished second rod 81 is equal to the actual cross-sectional area of the finished valve hole 66 when the cross-sectional area of the second 81 is at the minimum extent of the tolerance range and the cross-sectional area of the valve hole 66 is at the maximum extent of the tolerance range. The design cross-sectional area of the second rod 81 is larger than the design cross-sectional area of the valve hole 66, preferably by 1 to 8%, more preferably by 1.5 to 6%, and most preferably by 2 to 5%. Determining the design cross-sectional areas of the second rod 81 and the valve hole 66 in such manner prevents the actual cross-sectional area of the finished second rod 81 from being smaller than the actual cross-sectional area of the finished valve hole 66.

A small chamber 84 is defined by the inner wall of the rear housing 13 and the surface of the valve 49 at a position corresponding to the third port 74. The small chamber 84 is connected to the valve hole 66-by the third port 74. A communication groove 82 is formed in a side of the fixed core 76, and opens in the plunger chamber 77. A communication passage 83 is formed in the middle portion of the housing 61 for communicating the groove 82 with the small chamber 84. Accordingly, the plunger chamber 77 is connected to the valve hole 66 by the groove 82, the communication passage 83, the small chamber 84, and the third port 74. This equalizes the pressure in the plunger chamber 77 with the pressure in the valve hole 66 (pressure Ps in the crank chamber 15). The plunger 78 is provided with a through hole 85 that communicates the upper portion of the plunger chamber 77 with the lower portion of the chamber 77.

A cylindrical coil 86 is wound about the fixed core 76 and the plunger 78. The driving circuit 60 provides the coil 86 with electric current based on commands from the computer 57. The computer 57 determines the magnitude of the current provided to the coil 86.

The operation of the above described compressor will now be described.

When the air conditioner starting switch 59 is on, if the temperature detected by the compartment temperature sensor 58*a* is higher than a target temperature set by the temperature adjuster 58, the computer 57 commands the driving circuit 60 to excite the solenoid 62. Accordingly, electric current having a certain magnitude is sent to the coil 86 from the driving circuit 60. This produces a magnetic attractive force between the fixed core 76 and the plunger 78, as illustrated in FIGS. 2 and 3, in accordance with the current magnitude. The attractive force is transmitted to the valve body 64 by the second rod 81 and thus urges the valve body 64 against the force of the first spring 65 in a direction closing the valve hole 66. On the other hand, the length of the bellows 70 varies in accordance with the suction pressure Ps in the suction passage 32, which is introduced to the pressure sensing chamber 68 via the pressure introduction passage 50. The changes in the length of the bellows 70 are transmitted to the valve body 64 by the first rod 72. The higher the suction pressure Ps is, the shorter the bellows 70 becomes. As the bellows 70 becomes shorter, the bellows 70 moves the valve body 64 in a direction closing the valve hole 66.

The opening area between the valve body 64 and the valve hole 66 is determined by the equilibrium of the forces acting on the valve body 64. Specifically, the opening area is determined by the equilibrium position of the body 64, which is affected by the force of the solenoid 62, the force of the bellows 70, the force of the first spring 65 and the force of the second spring 79.

When the cooling load is great, the suction pressure Ps is high and the temperature in the vehicle compartment detected by the senzor 58*a* is higher than a target temperature set by the temperature adjuster 58. The computer 57 commands the driving circuit 60 to increase the magnitude of the current sent to the coil 86 as the difference between the compartment temperature and the target temperature increases. This increases the attractive force between the fixed core 76 and the plunger 78, thereby increasing the resultant force that causes the valve body 64 to close the valve hole 66. Accordingly, the pressure Ps required for moving the valve body 64 in a direction closing the valve hole 66 is lowered. In this state, the valve body 64 changes the opening of the valve hole 66 in accordance with a relatively low suction pressure Ps. In other words, increasing the magnitude of the current to the control valve 49 causes the valve 49 to maintain the pressure Ps (the target suction pressure) at a lower level.

A smaller gap between the valve body 64 and the valve hole 66 decreases the amount of refrigerant gas flow from the discharge chamber 38 to the crank chamber 15 via the supply passage 48. On the other hand, refrigerant gas in the crank chamber 15 flows into the suction chamber 37 via the pressure release passage 46 and the pressure release hole 47, which lowers the pressure Pc in the crank chamber 15. Further, since the auction pressure Ps is high when the cooling load is great, the pressure in each cylinder bore 11*a* is high. Therefore, the difference between the pressure Pc in the crank chamber 15 and the pressure in each cylinder bore 11*a* is small and thus increases the inclination of the awash plate 22. Accordingly, the compressor operates at a large displacement.

When the valve hole 66 in the control valve 49 is completely closed by the valve body 64, the supply passage 48 is closed. This stops the supply of the highly pressurized refrigerant gas in the discharge chamber 38 to the crank chamber 15. Therefore, the pressure Pc in the crank chamber 15 becomes substantially equal to the low pressure Ps in the suction chamber 37. The inclination of the swash plate 22 thus becomes maximum as shown in FIGS. 2 and 3, and the compressor operates at the maximum displacement. The abutment of the swash plate 22 against the projection 21*a* of the rotor 21 prevents the swash plate 22 from inclining beyond the predetermined maximum inclination.

When the cooling load is small, the suction pressure Ps is low and the difference between the compartment temperature detected by the sensor 58*a* and a target temperature set by the temperature adjuster 58 is small. The computer 57 commands the driving circuit 60 to decrease the magnitude of the current sent to the coil 87 as the difference between the compartment, temperature and the target temperature becomes smaller. This decreases the attractive force between the fixed core 76 and the plunger 78, thereby decreasing the resultant force that moves the valve body 64 in a direction closing the valve hole 66. Accordingly, the value of the pressure Ps required for moving the valve body 64 in a direction closing the valve hale 66 is increased. In this state, the valve body 64 changes the opening size of the valve hole 66 in accordance with a relatively high suction pressure Ps. In other words, decreasing the magnitude of the current to the control valve 49 causes the valve 49 to maintain the pressure Ps (target suction pressure) at a higher level.

Enlarging the opening between the valve body 64 and the valve hole 66 increases the amount of refrigerant gas flow from the discharge chamber 38 to the crank chamber 15. The increased gas flow amount increases the pressure Pc in the crank chamber 15. Further, since the suction pressure Ps is low when the cooling load is small, the pressure in. the cylinder bores 11*a* is low. Therefore, the difference between the crank chamber pressure Pc and the pressure in the cylinder bores 11*a* is great and thus decreases the inclination of the awash plate 22 Accordingly, the compressor operates at a small displacement.

As the cooling load approaches zero, the temperature of the evaporator 55 in the external refrigerant circuit 52 drops to a frost forming temperature. When the temperature sensor 56 detects a temperature that it equal to or lower than the frost forming temperature, the computer 57 commands the driving circuit 60 to de-excite the solenoid 62. The driving circuit 60 stops sending current to the coil 86, accordingly. This stops the magnetic attractive force between the fixed core 76 and the plunger 78. The valve body 64 is then moved by the force of the first spring 65 against the weaker force of the second spring 81 transmitted by the plunger 78 and the second rod 81 as illustrated in FIG 4. In other words, the valve body 64 is moved in a direction opening the valve hole 66. This maximizes the size of the opening between the valve body 64 and the valve hole 66. Accordingly, gas flow from the discharge chamber 38 to the crank chamber 15 is increased. This further raises the pressure Pc in the crank chamber 15, thereby minimizing the inclination of the swash plate 22. The compressor thus operates at the minimum displacement.

When the switch 59 is turned off, the computer 57 commands the driving circuit 60 to de-excite the solenoid 62. Accordingly, the inclination of the swash plate 22 is minimized.

As described above, when the magnitude of the current to the coil 86 is increased, the valve body 64 functions such that the valve hole 66 is closed by a lower suction pressure Ps. When the magnitude of the current to the coil 86 is decreased, on the other hand, the valve body 64 functions such that the valve hole 66 is closed by a higher suction pressure Ps. The compressor changes the inclination of the swash plate 22 to adjust its displacement thereby maintaining the suction pressure Ps at a target value. Accordingly, the functions of the control valve 49 include changing the target value of the suction pressure Ps in accordance with the magnitude of the supplied current and allowing the compressor to operate at the minimum displacement at any given suction pressure Ps by maximizing the opening area of the valve hole 66. A compressor equipped with the control valve 49, which has these functions, varies the cooling ability of the air conditioner.

When the inclination of the swash plate 22 is minimum as illustrated in FIG. 4, the shutter 28 abuts against the positioning surface 33. This prevents the inclination of the swash plate 22 from being less than the predetermined minimum inclination. The abutment also disconnects the suction passage 32 from the suction chamber 37. This stops gas flow from the external refrigerant circuit 52 to the suction chamber 37, thereby stopping the circulation of refrigerant gas between the circuit 52 and the compressor.

The minimum inclination of the swash plate 22 is slightly larger than zero degrees. Zero degrees refers to the angle of the swash plate's inclination when it is perpendicular to the axis of the drive shaft 16. Therefore, even if the inclination of the swash plate 22 is minimum, refrigerant gas in the cylinder bores 11*a* is discharged to the discharge chamber 38 and the compressor operates at the minimum displacement. The refrigerant gas discharged to the discharge chamber 38 from the cylinder bores 11*a* enters the crank chamber 15 through the supply passage 48. The refrigerant gas in the crank chamber 15 is drawn back into the cylinder bores 11*a* through the pressure release passage 46, the pressure release hole 47 and the suction chamber 37. That is, when the inclination or the swash plate 22 is minimum, refrigerant gas circulates within the compressor traveling through the discharge chamber 38, the supply passage 48, the crank chamber 15, the pressure release passage 46, the pressure release hole 47, the suction chamber 37 and the cylinder bores 11*a*. This circulation of refrigerant gas allows lubricant oil contained in the gas to lubricate the moving parts of the compressor.

If the switch 59 is on and the inclination of the swash plate 22 is minimum, an increase in the compartment temperature increases the cooling load. In this case, the temperature detected by the compartment temperature sensor 58*a* is higher than a target temperature set by the compartment temperature adjuster 58. The computer 57 commands the driving circuit 60 to excite the solenoid 62 based on the detected temperature increase. When the solenoid 62 is excited, the supply passage 48 is closed. This stops the flow of refrigerant gas from the discharge chamber 38 into the crank chamber 15. The refrigerant gas in the crank chamber 15 flows into the suction chamber 37 via the pressure release passage 46 and the pressure release hole 47. This gradually lowers the pressure Pc in the crank chamber 15, thereby moving the swash plate 22 from the minimum inclination to the maximum inclination.

As the inclination of the swash plate 22 increases, the force of the spring 29 gradually pushes the shutter 28 away from the positioning surface 33. This gradually enlarges the cross-sectional area of the passage between the suction passage 32 and the suction chamber 37. Accordingly, the amount of refrigerant gas flow from the suction passage 32 into the suction chamber 37 gradually increases. Therefore, the amount of refrigerant gas that enters the cylinder bores 11*a* from the suction chamber 37 gradually increases. The displacement of the compressor gradually increases, accordingly. The discharge pressure Pd of the compressor gradually increases and the torque for operating the compressor also gradually increases. In this manner, the torque of the compressor does not dramatically change in a short time when the displacement changes from the minimum to the maximum. This reduces the shock that accompanies load torque fluctuations.

If the engine E is stopped, the compressor is also stopped, that is, the rotation of the swash plate 22 is stopped, and the supply of current to the coil 86 in the control valve 49 is stopped. This de-excites the solenoid 62, thereby opening the supply passage 48. In this state, the inclination of the swash plate 22 is minimum, If the nonoperational state of the compressor continues, the pressures in the chambers of the compressor become equalized and the swash plate 22 is kept at the minimum inclination by the force of spring 26. Therefore, when the engine E is started again, the compressor starts operating with the swash plate 22 at the minimum inclination. This requires the minimum torque. The shock caused by starting the compressor is thus reduced.

Figure 5:
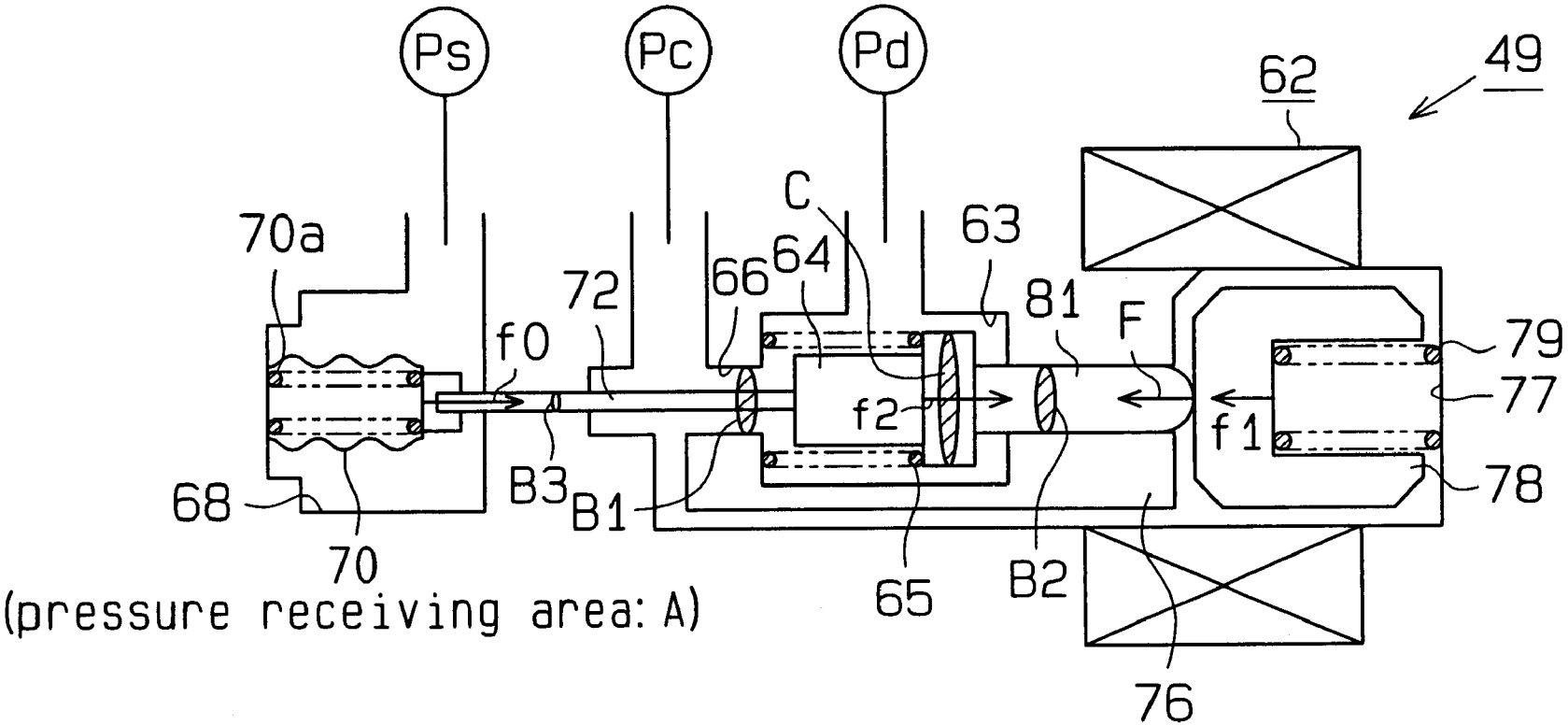
FIG. 5 is a diagram illustrating the forces acting on the valve body.

The forces acting on the valve body 64 of the control valve 49 will now be described with reference to FIG. 5. The equilibrium of the forces acting on the valve body 64 is represented by the following equation (1). The left side of the equation (1) represents the resultant force urging the valve body 64 in a direction to open the valve hole 66, whereas the right side represents the resultant force urging the valve body 64 in a direction to close the valve hole 66.

$$f0-(A-B3)Ps+(B1-B3)Pc+(C-B1)Pd+f2=(C-B2)Pd+F+f1+B2\cdot Pc \quad (1)$$

wherein

A is the pressure receiving area of the bellows 70;

B1 is the cross-sectional area of the valve hole 66;

B2 is the cross-sectional area of the second rod 81;

B3 is the cross-sectional area of the first rod 72;

C is the pressure receiving area of the valve body 64 in its moving direction;

F is the magnitude of electromagnetic force generated by exiting the coil 86;

f0 is the urging force of the bellows spring 70*a;* f1 is the urging force of the second spring 79; and f2 is the urging force of the first spring 65.

The equation (1) can be changed to the following equation (2).

$$(f0-A\cdot Ps)+f2=(B1-B2)(Pd-Pc)+F+f1+B3\ (Pc-Ps) \quad (2)$$

When the compressor is operating at the maximum displacement and the discharge pressure Pd is high, the difference between the discharge pressure Pd and the crank chamber pressure Pc is great. That is, an inequality Pd−Pc >>0 is satisfied. On the other hand, if the cross-sectional area B1 of the valve hole 66 is larger than the cross-sectional area B2 of the second rod 81, an inequality B1−B2>0 is satisfied. Therefore, the element (B1−B2)(Pd−Pc) in the equation (2) represents a great force urging the valve body 64 in a direction to close the valve hole 66.

If the cooling load becomes small in this state, the computer 57 de-excites the coil 86 thereby eliminating the electromagnetic attractive force F. The suction pressure Ps is lowered and becomes substantially equal to the crank chamber pressure Pc. Therefore, the element 33(Pc−Ps) in the equation (2) is assumed to be zero. If the value of the element (B1−B2) (Pd−Pc) is great, the value of the right side (B1−B2)(Pd−Pc)+f1 is greater than the value of the left side (f0−A·Ps)+f2. In other words, the force urging the valve body 64 in a direction to close the valve hole 66 is greater than the force urging the valve body 64 in a direction to open the valve hole 66. Thus, even if the computer 57 de-excites the coil 86 for increasing the opening between the valve hole 66 and the valve body 64, the valve hole 66 remains closed by valve body 64.

Contrarily, in the control valve 49 according to this embodiment, the design cross-sectional area of the second rod 81 is slightly larger than the design cross-sectional area of the valve hole 66. Specifically, the difference is determined such that the actual cross-sectional area B2 of the finished second rod 81 is equal to the actual cross-sectional area B1 of the finished valve hole 66 when the cross-sectional area B2 of the second rod 81 is at the minimum limit of the tolerance range and the cross-sectional area B1 of the valve hole 66 is at the maximum limit of the tolerance range.

Therefore, the actual cross-sectional area B2 of the second rod 81 in always equal to or greater than the actual cross-sectional areaB1 of the valve hole 66, and an equation (B1−B2≦0) is always satisfied in the equation (2). The element (B1−B2) (Pd−Pc) in the equation (2) is zero or represents a force urging the valve body 64 in a direction to open the valve hole 66. In this case, even if the discharge pressure Pd is greatly different from the crank chamber pressure Pc, the valve body 64 is not pressed hard against the valve hole 66. Thus, when the computer 57 de-excites the coil 86 to cause the valve body 64 to increase the opening of the valve hole 66, the valve body 64 positively opens the valve hole 66.

The pressure Pd in the discharge chamber 38 acting on the valve body 64 will now be described. The pressure Pd in the discharge chamber 38 acts on the valve chamber 66, which accommodates the valve body 64, via the supply passage 48 and the first port 67. The valve body 64 is therefore located in refrigerant gas having the discharge pressure Pd. The pressure Pd generates a force that moves the valve body 64 in a direction opening the valve hole 66 and a force that moves the valve body 64 in a direction closing the valve hole 66. Also, as described above, the cross-sectional area B2 of the second rod 81 is equal to or slightly larger within the tolerance than the cross-sectional area B1 of the valve hole 66, which faces the valve body 64. Therefore, if the part to which the second rod 81 is coupled and the part facing the first valve hole 66 are not taken into account, the force based on the pressure Pd that urges the valve body 64 in a direction closing the valve hole 66 is substantially equal to the force based on the pressure Pd that urges the valve body 64 in a direction opening the valve hole 66. Thus, the discharge pressure Pd has no net errect. The discharge pressure Pd does not affect the movement of the first valve body 90.

The crank chamber pressure Pc that acts on the valve body 64 will now be described. The pressure Pc in the crank chamber Pc is supplied to the valve hole 66 via the supply passage 48 and the third port 74. The pressure Pc in the valve hole 66 communicate, with the plunger chamber 77 via the small chamber 84, the communication passage 83 and the communication groove 82. Therefore, the pressure in the valve hole 66 is equal to the pressure in the plunger chamber 77.

The cross-sectional area B3 of the first rod's large diameter portion 72*a* is smaller than the cross-sectional area B1 of the valve hole 66. Therefore, the pressure Pc in the valve hole 66 urges the valve body 64 in a direction opening the valve hole 66 by a force based on the difference between the cross-sectional area B3 of the portion 72*a* and the cross-sectional area B1 of the valve hole 66. On the other hand, the pressure Pc in the plunger chamber 77 acts on the distal end of the second rod 81, the cross sectional area B2 of which is substantially the same as or slightly larger than the cross-sectional area B1 of the valve hole 66. The pressure Pc in the chamber 77 urges the valve body 64 in a direction closing the valve hole 66. Therefore, the small cross-sectional area B3 of the portion 72*a* represents the small difference between a force based on the pressure Pc that urges the valve body 64 in a direction closing the hole 66 and a force based on the pressure Pc that urges the valve body 64 in a direction opening the hole 66. Accordingly, the forces based on the crank chamber pressure Pc acting on the valve body 64 nearly cancel each other. That is, the cross-sectional area of the portion 72*a* is made as small as possible to decrease the difference between the opposing forces.

There is thus no need to increase the attractive force between the fixed core 76 and the plunger 78 for moving the valve body 64 against the forces based on the discharge pressure Pd and the crank chamber pressure Pc. Further, the valve body 64 quickly responds to expansion and contraction of the bellows 70, which reacts to changes in the suction pressure Ps. Thus, even if the value of current supplied to the coil 86 is small, or if changes in the suction pressure Ps are subtle, the valve body 64 accurately controls the opening of the valve hole 66 based on the actuation of the solenoid 62 and the bellows 70.

Further, the valve body 64 is not pressed forcefully against the valve hole 66 even if the pressure Pd is high. Therefore, if the current supplied to the coil 86 is reduced or stopped when the valve hole 66 is closed by the valve body 66, the valve body 64 is positively moved in a direction opening the valve hole 66. Thus, unlike the prior art control valve, the valve body 64 is moved to open the valve hole 66 without increasing the attractive force between the fixed core 76 and the plunger 78. This reduces the size of the solenoid 62 and the power consumption of the compressor. The control valve 49 is suitable for a clutchless type variable displacement compressor that is directly connected to an external driving force E.

Figure 6:
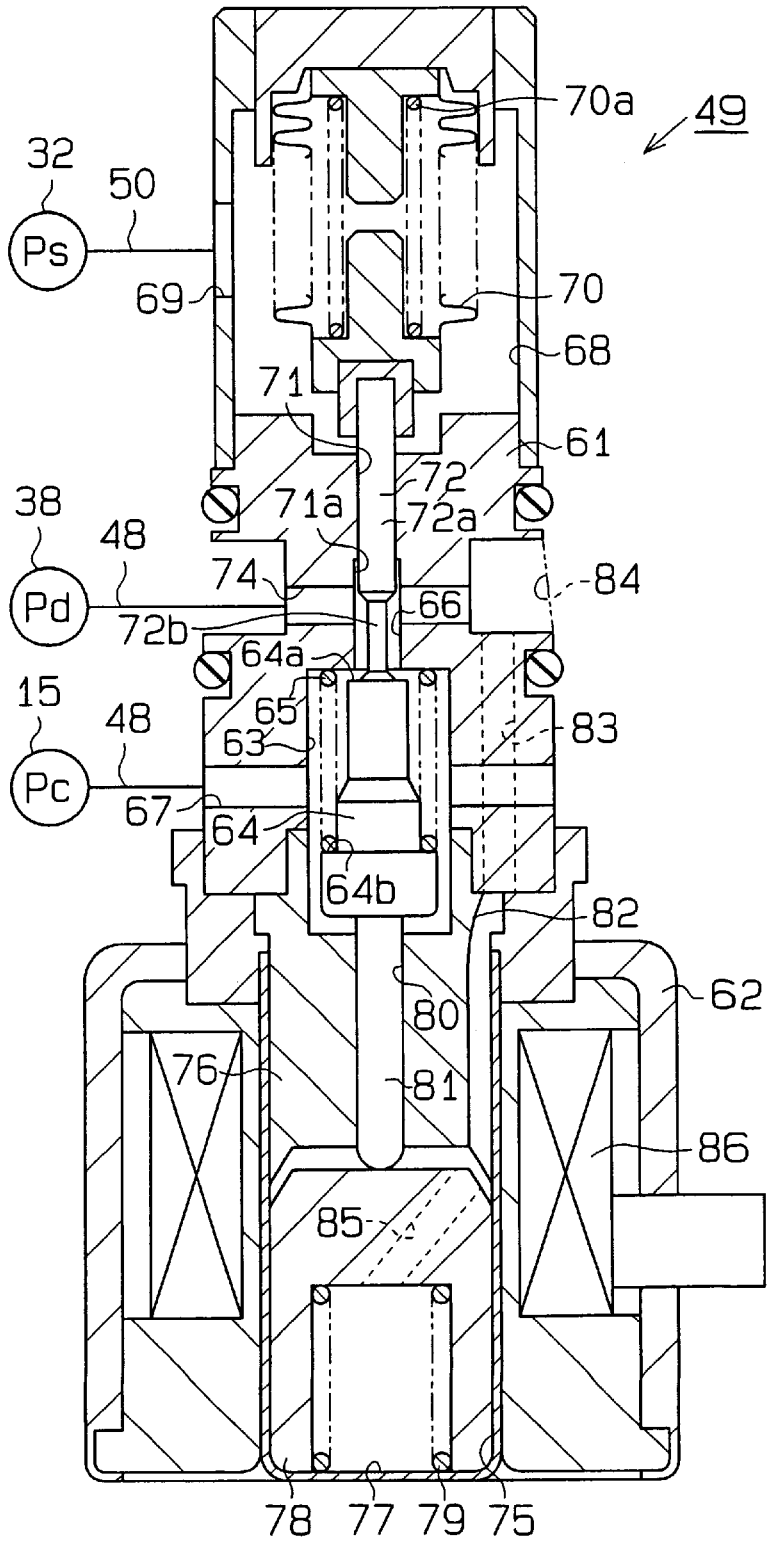
FIG. 6 is a cross-sectional view illustrating a control valve according to another embodiment or the present invention.
Figure 7:
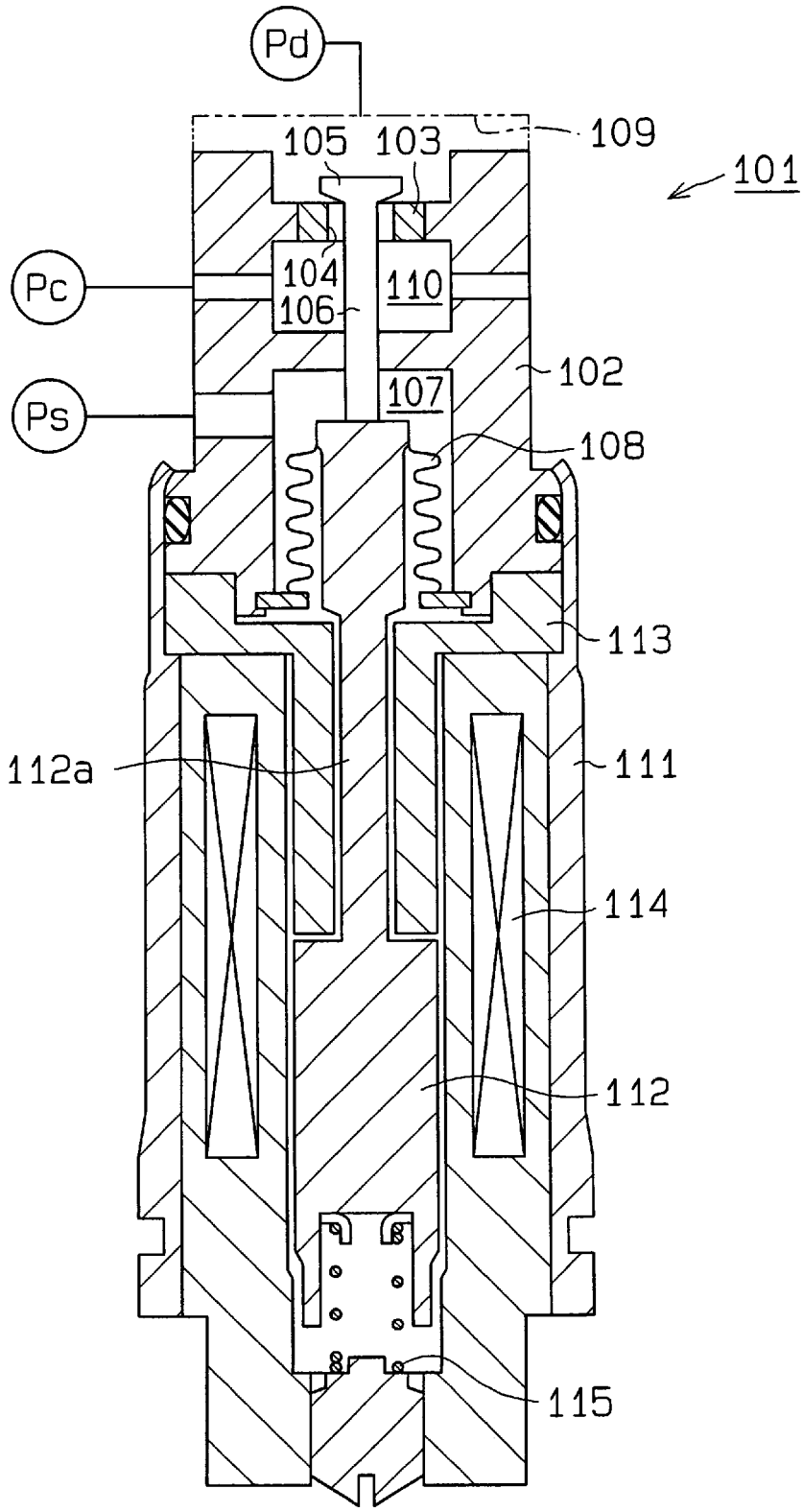
Fig.7 (Prior Art)
FIG. 7 is a cross-sectional view illustrating a prior art control valve.

The present invention may be alternatively embodied in the following forms:

As illustrated in FIG. 6, the third port 74 may be connected to the discharge chamber 38 by the upstream portion of the suction passage 48 for introducing the discharge pressure Pd to the valve hole 66 and to the plunger chamber 77. In this case, the first port 67 may be connected to the crank chamber 15 by the downstream portion of the supply passage 48 for introducing the crank chamber pressure Pc into the valve chamber 63. This construction also causes the force based on the discharge pressure Pd acting on the valve body 64 and the force based on the crank chamber pressure Pc acting on the valve body 64 to nearly cancel each other.

The control valve 49 according to the first embodiment may be incorporated in a variable displacement compressor in which the drive shaft 16 is coupled to the external drive source E with a clutch in between. In this case, it is preferable to disengage the clutch only when the air conditioner starting switch 59 is off and to engage the clutch only when the switch 59 is on. This allows the clutch type compressor to operate in the same manner as the clutchless type compressor illustrated in FIG. 2. Accordingly, the number of times the clutch is engaged is significantly reduced, and the riding comfort or the vehicle is therefore improved.

The compressor of FIG. 2 adjusts the pressure in the crank chamber 15 for controlling the displacement of the compressor. However, the displacement may be controlled in different manners. For example, the amount of refrigerant gas supplied to the suction chamber 37 from the external refrigerant circuit 52 may be changed for controlling the pressure in the cylinder bores 11*a* for changing the displacement of the compressor.

A passage for introducing the pressure Pc in the crank chamber 15 to the plunger chamber 77 may be formed separately from the supply passage 48.

Therefore, the prevent examples and embodiments are to be considered as illustrative and not restrictive and the invention is not to be limited to the details given herein, but may be modified within the scope and equivalence of the appended claims.

What is claimed is:

1. A control valve for adjusting the amount of gas flowing in a gas passage in accordance with an operating pressure applied to the control valve, the control valve comprising:

a housing, the housing including a valve hole and a valve chamber located in the gas passage, wherein the valve hole communicates with the valve chamber;

a movable valve body located in the valve chamber in close proximity to the valve hole, wherein the valve body restricts the valve hole;

a reacting member for reacting to the operating pressure;

a first rod located between the reacting member and the valve body to transmit the reaction of the reacting member to the valve body;

a solenoid located on the opposite side of the valve body from the reacting member, the solenoid including a plunger chamber and a plunger movably accommodated in the plunger chamber, wherein a certain level of electric current is applied to the solenoid; and a second rod located between the plunger and the valve body and located on the opposite side of the valve body from the valve hole, wherein the plunger applies a force to the valve body through the second rod, wherein the force applied by the plunger is based on the level of electric current supplied to the solenoid, and wherein a design cross-sectional area of the second rod is larger than a design cross-sectional area of the valve hole, and the difference between the design cross-sectional area of the second rod and the design cross-sectional area of the valve hole and their manufacturing tolerances are determined such that the cross-sectional area of the finished second rod is no smaller than the cross-sectional area of the finished valve hole when the cross-sectional area of the finished second rod is at the minimum tolerated limit and the cross-sectional area of the finished valve hole is at the maximum tolerated limit.

2. The control valve according to claim 1, wherein the gas passage has an upstream portion that is upstream of the control valve and a downstream portion that is downstream of the control valve, wherein one of the upstream portion and the downstream portion communicates with the valve chamber, and the other communicates with the valve hole and the plunger chamber.

3. The control valve according to claim 1, wherein the difference between the design cross-sectional area of the second rod and the design cross-sectional area of the valve hole and their manufacturing tolerances are determined such that the cross-sectional area of the finished second rod is equal to the cross-sectional area of the finished valve hole when the cross-sectional area of the finished second rod is at the minimum tolerated limit and the cross-sectional area of the finished valve hole is at the maximum tolerated limit.

4. The control valve according to claim 1, wherein the design cross-sectional area of the second rod is larger than the design cross-sectional area of the valve hole by 1 to 8%.

5. The control valve according to claim 1 further comprising a passage for connecting the plunger chamber with the valve hole for equalizing the pressure between the plunger chamber and the valve hole.

6. The control valve according to claim 1, wherein the reacting member and the valve body are arranged such that the reacting member moves the valve body toward the valve hole through the first rod to further restrict the valve hole in accordance with an increase of the operating pressure.

7. The control valve according to claim 6, wherein the plunger biases the valve body toward the valve hole with the second rod in accordance with the level of the electric current supplied to the solenoid.

8. The control valve according to claim 7 further comprising biasing means for biasing the valve body away from the valve hole, wherein the biasing means minimizes the restriction of the valve hole when the solenoid is de-excited.

9. A control valve in a variable displacement compressor that adjusts the discharge displacement in accordance with the inclination of a drive plate located in a crank chamber, wherein the compressor includes a piston operably coupled to the drive plate, the piston being located in a cylinder bore, wherein the piston compresses gas supplied to the cylinder bore from a suction chamber and discharges the compressed gas to a discharge chamber from the cylinder bore, wherein the inclination of the drive plate varies according to the difference between the pressure in the crank chamber and the pressure in the cylinder bore, wherein the compressor further includes the adjusting device for adjusting the differences between the pressure in the crank chamber and the pressure in the cylinder bore, wherein the adjusting device includes the control valve and a gas passage for conducting gas, wherein the control valve regulates the amount of the gas flowing in the gas passage, the control valve comprising:

a housing, the housing including a valve hole and a valve chamber located in the gas passage, wherein the valve hole communicates with the valve chamber;

a movable valve body located in the valve chamber in close proximity to the valve hole, wherein the valve body restricts the valve hole;

a reacting member for reacting to the operating pressure;

a first rod located between the reacting member and the valve body to transmit the reaction of the reacting member to the valve body;

a solenoid located on the opposite side of the valve body from the reacting member, the solenoid including a plunger chamber and a plunger movably accommodated in the plunger chamber, wherein a certain level of electric current is applied to the solenoid; and a second rod located between the plunger and the valve body and located on the opposite side of the valve body from the valve hole, wherein the plunger applies a force to the valve body through the second rod, wherein the force applied by the plunger is based on the level of electric current supplied to the solenoid, and wherein a design cross-sectional area of the second rod is larger than a design cross-sectional area of the valve hole, and the difference between the design cross-sectional area of the second rod and the design cross-sectional area of the valve hole and their manufacturing tolerances are determined such that the cross-sectional area of the finished second rod is no smaller than the cross-sectional area of the finished valve hole when the cross-sectional area of the finished second rod is at the minimum tolerated limit and the cross-sectional area of the finished valve hole is at the maximum tolerated limit.

10. The control valve according to claim 9, wherein the difference between the design cross-sectional area of the second rod and the design cross-sectional area of the valve hole and their manufacturing tolerances are determined such that the cross-sectional area of the finished second rod is equal to the cross-sectional area of the finished valve hole when the cross-sectional area of the finished second rod is at the minimum tolerated limit and the cross-sectional area of the finished valve hole is at the maximum tolerated limit.

11. The control valve according to claim 9, wherein the design cross-sectional area of the second rod is larger than the design cross-sectional area of the valve hole by 1 to 8%.

12. The control valve according to claim 9, wherein the gas passage has an upstream portion that is upstream of the control valve and a downstream portion that is downstream of the control valve, and wherein the valve chamber is connected with the discharge chamber by the upstream portion of the gas passage, and the valve hole and the plunger chamber communicate with the crank chamber by the downstream portion of the gas passage.

13. The control valve according to claim 9, wherein the gas passage has an upstream portion that is upstream of the control valve and a downstream portion that is downstream of the control valve, and wherein the valve chamber is connected with the crank chamber by the downstream portion of the gas passage, and the valve hole and the plunger chamber communicate with the discharge chamber by the upstream portion of the gas passage.

14. The control valve according to claim 9 further comprising a passage for connecting the plunger chamber with the valve hole for equalizing the pressure between the plunger chamber and the valve hole.

15. The control valve according to claim 9, wherein the gas passage is a supply passage connecting the discharge chamber with the crank chamber for supplying gas from the discharge chamber to the crank chamber, and wherein the control valve is located in the supply passage for adjusting the amount of gas supplied to the crank chamber from the discharge chamber through the supply passage to control the pressure in the crank chamber.

16. The control valve according to claim 9, wherein the reacting member and the valve body are arranged such that the reacting member moves the valve body toward the valve hole through the first rod to further restrict the valve hole in accordance with an increase in the pressure of gas supplied to the compressor.

17. The control valve according to claim 16, wherein the plunger biases the valve body toward the valve hole with the second rod in accordance with the level of the electric current supplied to the solenoid.

18. The control valve according to claim 17 further comprising biasing means for biasing the valve body away from the valve hole, wherein the biasing means minimizes the restriction of the valve hole when the solenoid is de-excited.

19. A method of manufacturing a control valve for adjusting the amount of gas flowing in a gas passage in accordance with an operating pressure applied to the control valve, the control valve having:

a housing, the housing including a valve hole and a valve chamber located in the gas passage, wherein the valve hole communicates with the valve chamber;

a movable valve body located in the valve chamber in close proximity to the valve hole, wherein the valve body restricts the valve hole;

a reacting member for reacting to the operating pressure;

a first rod located between the reacting member and the valve body to transmit the reaction of the reacting member to the valve body;

a solenoid for actuating the valve body, the solenoid including a plunger chamber and a plunger movably accommodated in the plunger chamber; and a second rod located between the plunger and the valve body, wherein the plunger applies a force to the valve body through the second rod, wherein the force applied by the plunger is based on the level of an electric current supplied to the solenoid, the method comprising:

setting a design cross-sectional area of the second rod and a design cross-sectional area of the valve hole such that the design cross-sectional area of the second rod is larger than the design cross-sectional area of the valve hole, wherein the difference between the design cross-sectional area of the second rod and the design cross-sectional area of the valve hole and their manufacturing tolerances are determined such that the cross-sectional area of the finished second rod is no smaller than the cross-sectional area of the finished valve hole when the cross-sectional area of the finished second rod is at the minimum tolerated limit and the cross-sectional area of the finished valve hole is at the maximum tolerated limit.

20. The method according to claim 19, further comprising setting the difference between the design cross-sectional area of the second rod and the design cross-sectional area of the valve hole such that the cross-sectional area of the finished second rod is equal to the cross-sectional area of the finished valve hole when the cross-sectional area of the finished second rod is at the minimum tolerated limit and the cross-sectional area of the finished valve hole is at the maximum tolerated limit.

21. The method of claim 19 wherein the design cross sectional area of the second rod is larger than the design cross sectional area of the valve hole by at least 1%.

22. A control valve for adjusting the amount of gas flowing in a gas passage in accordance with an operating pressure applied to the control valve, the control valve comprising:

a housing, the housing including a valve hole and a valve chamber located in the gas passage, wherein the valve hole communicates with the valve chamber;

a movable valve body located in the valve chamber in close proximity to the valve hole, wherein the valve body restricts the valve hole;

a reacting member for reacting to the operating pressure;

a first rod located between the reacting member and the valve body to transmit the reaction of the reacting member to the valve body;

a solenoid located on the opposite side of the valve body from the reacting member, the solenoid including a plunger chamber and a plunger movably accommodated in the plunger chamber, wherein a certain level of electric current is applied to the solenoid; and a second rod located between the plunger and the valve body and located on the opposite side of the valve body from the valve hole, wherein the plunger applies a force to the valve body through the second rod, wherein the force applied by the plunger is based on the level of electric current supplied to the solenoid, and wherein a design cross-sectional area of the second rod is larger than a design cross-sectional area of the valve hole, and the difference between the design cross-sectional area of the second rod and the design cross-sectional area of the valve hole and their manufacturing tolerances are determined such that the cross-sectional area of the finished second rod is larger than the cross-sectional area of the finished valve hole when the cross-sectional area of the finished second rod is at the minimum tolerated limit and the cross-sectional area of the finished valve hole is at the maximum tolerated limit.

* * * * *

UNITED STATES PATENT AND TRADEMARK OFFICE

CERTIFICATE OF CORRECTION

PATENT NO. : 6,200,105 B1
DATED : March 31, 2001
INVENTOR(S) : M. Kawaguchi et al.

It is certified that error appears in the above-identified patent and that said Letters Patent is hereby corrected as shown below:

Title page,
ABSTRACT,
Line 6, "level or" should read -- level of --

Column 3,
Line 42, "prof erred" should read -- preferred --

Column 4,
Line 1 should read:
-- Firstly, the structure of a variable displacement compressor will be described. As shown in FIG. 2, a front housing --
Lines 23 and 31, "awash" should read -- swash --
Line 32, "2S" should read -- 25 --
Line 37, " axis or" should read -- axis of --

Column 5,
Line 14, "axle" should read -- axis --
Line 17, "awash" should read -- swash --
Line 21, "shutter 20" should read -- shutter 28 --
Line 22, "shutter 26" should read -- shutter 28 --
Line 43, "roar" should read -- rear --

Column 6,
Line 6, "shaft 16 The pressure" should read -- shaft 16. The --
Line 11, "hole 41" should read -- hole 47 --

Column 7,
Line 5, "functions ma" should read -- functions as --
Line 60, "are*" should read -- area --

Column 8,
Line 27, "Ps" should read -- Pc --

Column 9,
Line 3, "senzor" should read -- sensor --
Line 30, "awash" should read -- swash --

UNITED STATES PATENT AND TRADEMARK OFFICE

CERTIFICATE OF CORRECTION

PATENT NO. : 6,200,105 B1
DATED : March 31, 2001
INVENTOR(S) : M. Kawaguchi et al.

It is certified that error appears in the above-identified patent and that said Letters Patent is hereby corrected as shown below:

Column 10,
Line 1, "in. the" should read -- in the --
Line 5, "awash" should read -- swash --

Column 11,
Line 6, "or the" should read -- of the --
Line 52, "minimum. If the" should read -- minimum. If the --

Column 13,
Line 48, the sentence starting with "Accordingly" should be a new paragraph Column 14,
Line 46, "prevent" should read -- present --

Signed and Sealed this

Twenty-sixth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,200,105 B1
DATED : March 13, 2001
INVENTOR(S) : M. Kawaguchi et al.

It is certified that error appears in the above-identified patent and that said Letters Patent is hereby corrected as shown below:

Title page,
ABSTRACT,
Line 6, "level or" should read -- level of --

Column 3,
Line 42, "prof erred" should read -- preferred --

Column 4,
Line 1, should read:
-- Firstly, the structure of a variable displacement compressor will be described. As shown in FIG. 2, a front housing --
Lines 23 and 31, "awash" should read -- swash --
Line 32, "2S" should read -- 25 --
Line 37, " axis or" should read -- axis of --

Column 5,
Line 14, "axle" should read -- axis --
Line 17, "awash" should read -- swash --
Line 21, "shutter 20" should read -- shutter 28 --
Line 22, "shutter 26" should read -- shutter 28 --
Line 43, "roar" should read -- rear --

Column 6,
Line 6, "shaft 16 The pressure" should read -- shaft 16. The --
Line 11, "hole 41" should read -- hole 47 --

Column 7,
Line 5, "functions ma" should read -- functions as --
Line 60, "are*" should read -- area --

Column 8,
Line 27, "Ps" should read -- Pc --

Column 9,
Line 3, "senzor" should read -- sensor --
Line 30, "awash" should read -- swash --

UNITED STATES PATENT AND TRADEMARK OFFICE

CERTIFICATE OF CORRECTION

PATENT NO. : 6,200,105 B1
DATED : March 13, 2001
INVENTOR(S) : M. Kawaguchi et al.

It is certified that error appears in the above-identified patent and that said Letters Patent is hereby corrected as shown below:

Column 10,
Line 1, "in. the" should read -- in the --
Line 5, "awash" should read -- swash --

Column 11,
Line 6, "or the" should read -- of the --
Line 52, "minimum. If the" should read -- minimum. If the --

Column 13,
Line 48, the sentence starting with "Accordingly" should be a new paragraph Column 14,
Line 46, "prevent" should read -- present --

This certificate supersedes Certificate of Correction issued March 26, 2002

Signed and Sealed this

Seventeenth Day of September, 2002

*Attest:*

*Attesting Officer*

JAMES E. ROGAN
*Director of the United States Patent and Trademark Office*